US005406926A

United States Patent [19]

Gu

[11] Patent Number: 5,406,926

[45] Date of Patent: Apr. 18, 1995

[54] SIGNAL GENERATOR FOR AN INTERNAL COMBUSTION ENGINE

[75] Inventor: Huan-Lung Gu, Hsinchu, Taiwan, Prov. of China

[73] Assignee: Industrial Technology Research Institute, Hsinchu, Taiwan, Prov. of China

[21] Appl. No.: 114,763

[22] Filed: Aug. 31, 1993

[51] Int. Cl.[6] ..... F02P 9/00

[52] U.S. Cl. ..... 123/617

[58] Field of Search ..... 123/617, 633, 146.5 A, 123/143 R

[56] References Cited

U.S. PATENT DOCUMENTS

| | | | |
|---|---|---|---|
| 3,100,480 | 8/1963 | Mennesson | 123/633 |
| 3,303,835 | 2/1967 | Richards | 123/633 |
| 3,600,530 | 9/1969 | Dusenberry | 123/633 |
| 4,166,201 | 8/1979 | Olander et al. | 123/633 |
| 4,186,286 | 1/1980 | Kuo et al. | 123/633 |
| 4,224,068 | 9/1980 | Harvey | 123/633 |
| 4,538,564 | 9/1985 | Ehrmann et al. | 123/146.5 A |
| 4,627,393 | 12/1986 | Takenaka | 123/146.5 A |
| 4,677,946 | 7/1987 | Tamagne | 123/146.5 A |
| 4,852,541 | 8/1989 | Kodama et al. | 123/617 |
| 4,903,673 | 2/1990 | Chiba et al. | 123/617 |
| 4,917,064 | 4/1990 | Kodama et al. | 123/617 |
| 5,028,868 | 7/1991 | Murata et al. | 123/617 |

*Primary Examiner*—Raymond A. Nelli

*Attorney, Agent, or Firm*—W. Wayne Liauh

[57] ABSTRACT

A signal generator for an internal combustion engine containing (1) a housing and (2) a shaft penetrating the housing, at least one asymmetrical vane type rotor coupled to the shaft, one signal element mounting plate, at least one signal element, and a stray noise isolating plate provided in the housing. The shaft is coupled with the engine to drive the asymmetrical vane type rotor to rotate synchronously with the engine and move pass the signal element so as to generate a square wave signal for controlling a fuel injection and ignition of the engine. The signal element mounting plate is mounted on the housing via an outer edge of the mounting plate, which is used as a fulcrum and to cause the signal element mounting plate to be fastened to the housing in such a manner so as to allow a large space to be provided by its top and bottom surfaces for mounting a increased number of the signal elements thereon. The stray noise isolating plate is mounted above the vane type rotor and the signal elements so as to form a closed space of the housing. The stray noise isolating plate provides the functions of shielding high voltage stray noises from being received by a microcomputer, which monitors the signal from the internal combustion engine, and preventing the ozone produced by sparks generated by the engine to enter the housing which could cause rusting.

7 Claims, 7 Drawing Sheets

SIGNAL GENERATOR FOR AN INTERNAL COMBUSTION ENGINE

BACKGROUND OF THE INVENTION

Conventionally, the internal combustion engine is equipped with a Hall effect sensor as a signal element in a signal generator (as shown in FIG. 7). In order to save space, the signal element mounting plate A1 is fastened around a bearing block A3 of a shaft A2 by means of the inner surface of the center hole of the mounting plate A1. If the bearing block A3 is furnished with at least three ribs, the signal element mounting plate A1 will be able to mount on the bearing block; such mounting method has the advantage of requiring less space, but the disadvantages are that: (1), since the signal element mounting plate is mounted around the bearing block by means of the inner surface of the center hole thereof, the fastening area and the moment of force are limited, i.e., the external diameter of the signal element mounting plate being unable to increase; otherwise, a vibration may result; (2), since the external diameter of the signal element mounting plate can not be increased, the distance between the signal element and the center of the shaft is very small, and therefore the timing signal generated by the rotation of the vane type rotor across the signal element has a poor resolution and precision; (3), since the bearing block is mounted under the bottom of the distributor, the difficulty and cost of installation of the signal wires from the signal element to the signal-output socket fastened to the housing become higher than normal; (4), when the conventional design is used, the bearing block is mounted under the signal element mounting plate, and there will be no space for the signal element; consequently, it would not work well when used in an advanced engine management system (i.e., two signal elements on a signal generator to produce two timing signals); (5), the conventional design has no stray noise isolating plate, and the signal it generates is not suitable to be used in a micro-computer control system.

SUMMARY OF THE INVENTION

This invention relates to a signal generator for an internal combustion engine, which comprises a housing, and a shaft rotatably mounted in the housing. At least one vane type rotor with right angle vanes parallel to the shaft is mounted on the shaft. A signal element mounting plate fastened to the housing, one or more than one signal element, a signal-output socket fastened to the housing, a stray noise isolating plate mounted on the opening of the housing to cover the same. One end of the shaft is engaged with a cam shaft or a crank shaft of an engine so as to rotate synchronously with the engine, and to drive the vane type rotor to rotate synchronously with the engine as well. When the vane type rotor rotates, it will move across the signal element, which is substantially a conventional Hall effect sensor. As soon as the magnetic-inductive vane type rotor moves across the Hall effect sensor, a square wave signal will be generated and transmitted, via the signal-output socket to a micro-computer control unit of the engine for controlling the fuel injection and ignition of the engine. When the ignition system uses a distributor the signal generator according to the present invention will be mounted under the distributor as one piece. If no distributor is used, the signal generator will be a separate assembly. The prime feature of the present invention is that the signal element mounting plate is fastened to the housing by means of the outer edge thereof as a fulcrum, while the conventional signal element mounting plate is mounted around bearing block of a shaft by means of the inner surface thereof. According to the present invention, the signal element mounting plate not only can be fastened in place firmly without vibration, but also can provide a larger space for mounting another signal element above and under itself to satisfy the requirement of furnishing more timing signals for a new engine management system. Moreover, the signal element can be mounted at a position far from the shaft so as to produce higher precision and higher resolution signal with the rotation of the vane type rotor across the signal element.

Another feature of the present invention is that the opposite position of the asymmetrical vane of the vane type rotor is furnished with holes so as to reduce the weight of the vane to maintain a rotary balance, i.e., to minimize the vibration of the vane type rotor.

Still another feature of the present invention is that a stray noise isolating plate is mounted over the signal generator. The isolating plate is conductive for shielding all high voltage stray noise caused by the sparks which jump off the distributor rotor, the ignition coil, the spark plugs and others sources. The noise isolating plate can also be used for isolating a considerable amount of ozone produced by the sparks off the distributor rotor. Since ozone is not stable gas, it can produce moisture in the distributor to cause the iron vane type rotor to rust. In case of rust dirt buildup, the signal element might suffer from a short circuit that would interfere with the timing signal, and the normal operation of the engine could be jeopardized. When the signal generator is not functioning as a distributor concurrently, the stray noise isolating plate can also be used as a cap to prevent dust, moisture and miscellaneous matter from entering the signal generator.

A further feature of the present invention is that both the top and bottom surfaces of the signal element mounting plate can used to fasten signal elements so as to meet the need if more timing signals are necessary without causing the sensor and the vane type rotor to be crowded together.

BRIEF DESCRIPTION OF THE DRAWINGS

FIG. 5 illustrates a fuel injection and ignition method with a timing signal for a conventional four-cylinder and four-stroke engine, in which:

(a), indicating the crank shaft angles with a coordinate diagram for a four-cylinder and four-stroke engine;

(b), indicating the wave form of the timing signal;

(c), indicating the ignition positions of the cylinders respectively;

(d), indicating the fuel injection position in the first and the fourth cylinders according to a multi-point group injection method;

(d'), indicating the fuel injection position in the second and the third cylinders according to a multi-point group injection method;

(e), indicating the fuel injection position according to a multi-point synchronous injection method;

(f), indicating the fuel injection position according to single-point throttle injection method.

Figure 6:
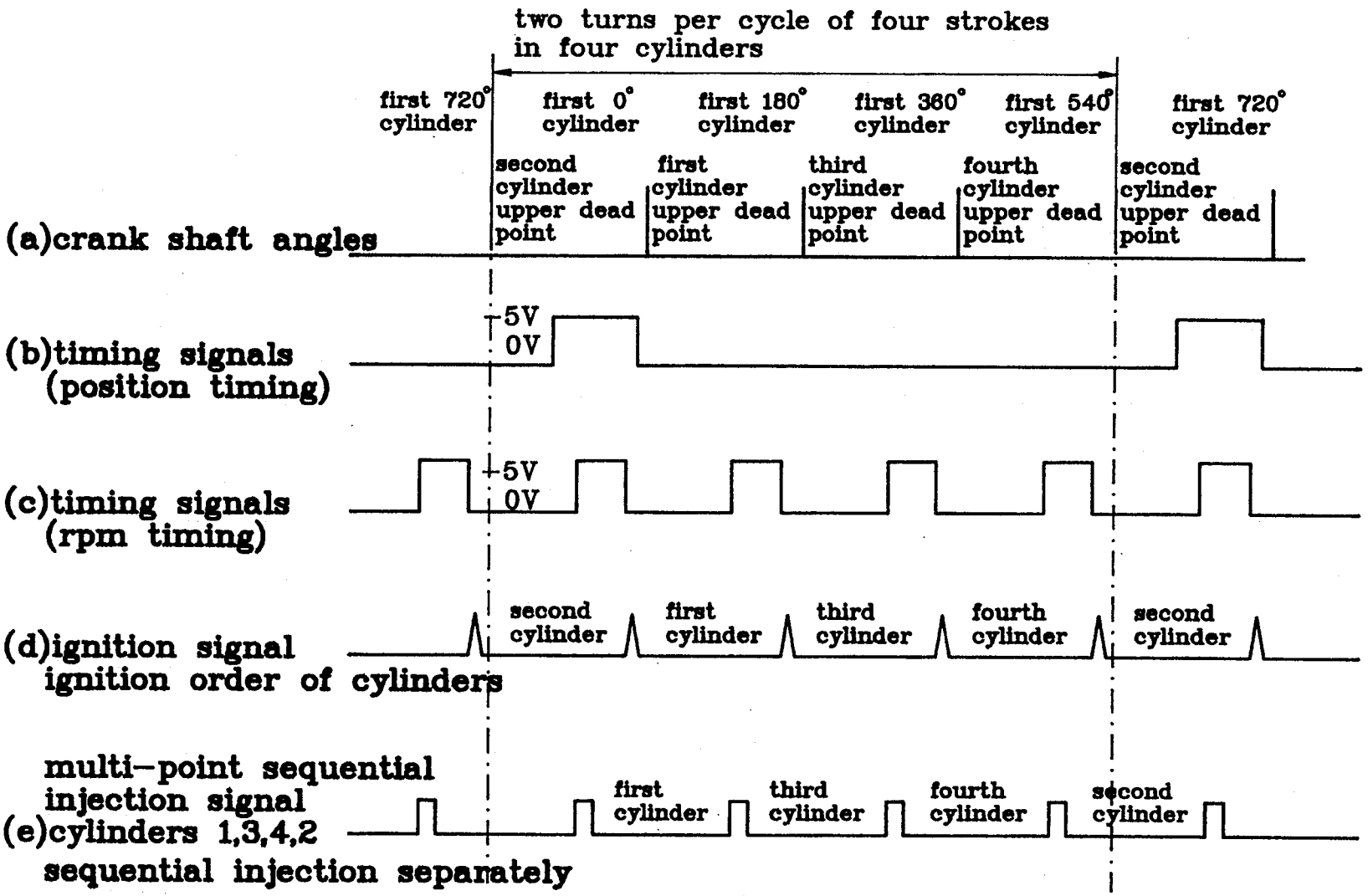

FIG. 6 illustrates the fuel-injection and ignition method in a conventional four-cylinder and four-stroke engine using two timing signals, in which:

(a), indicating the crank shaft angles with a coordinate diagram for a four-cylinder and four-stroke engine;

(b), indicating the wave form of a timing signal at a given position;

(c), indicating the wave form of a timing signal to count the rotation speed;

(d), indicating the ignition positions of the four cylinders respectively;

(e), indicating the fuel injection positions according to a multi-point sequential injection method.

Figure 7:
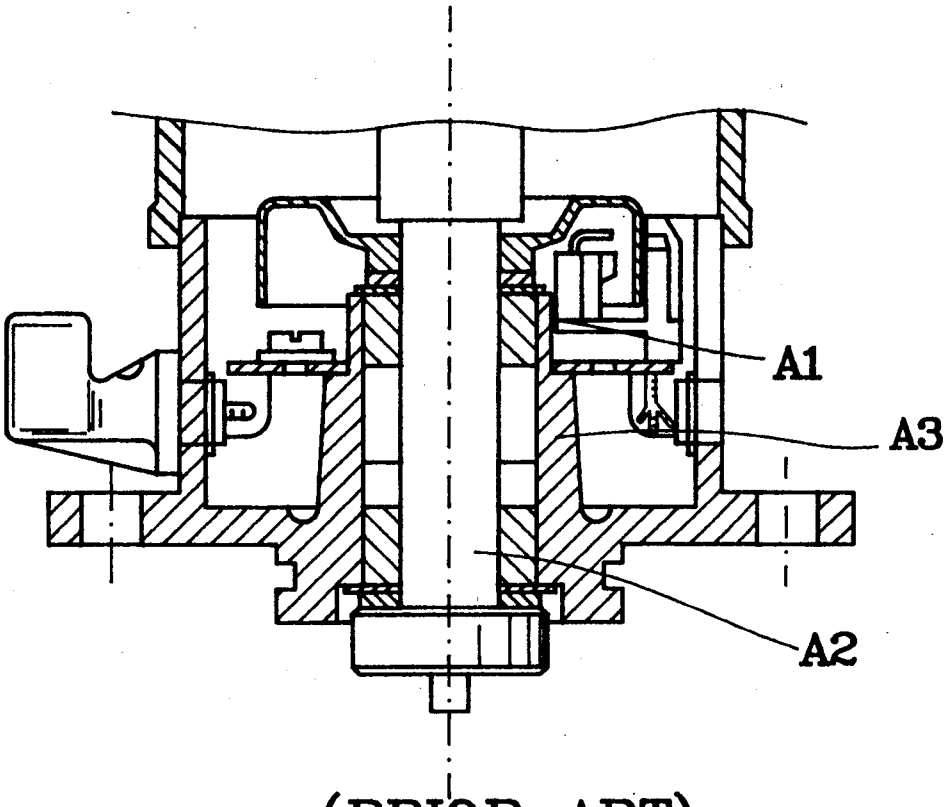
(PRIOR ART) FIG. 7

FIG. 7 is a sectional view of a conventional Hall effect sensor as a signal element in a signal generator.

DETAILED DESCRIPTION

Figure 1:
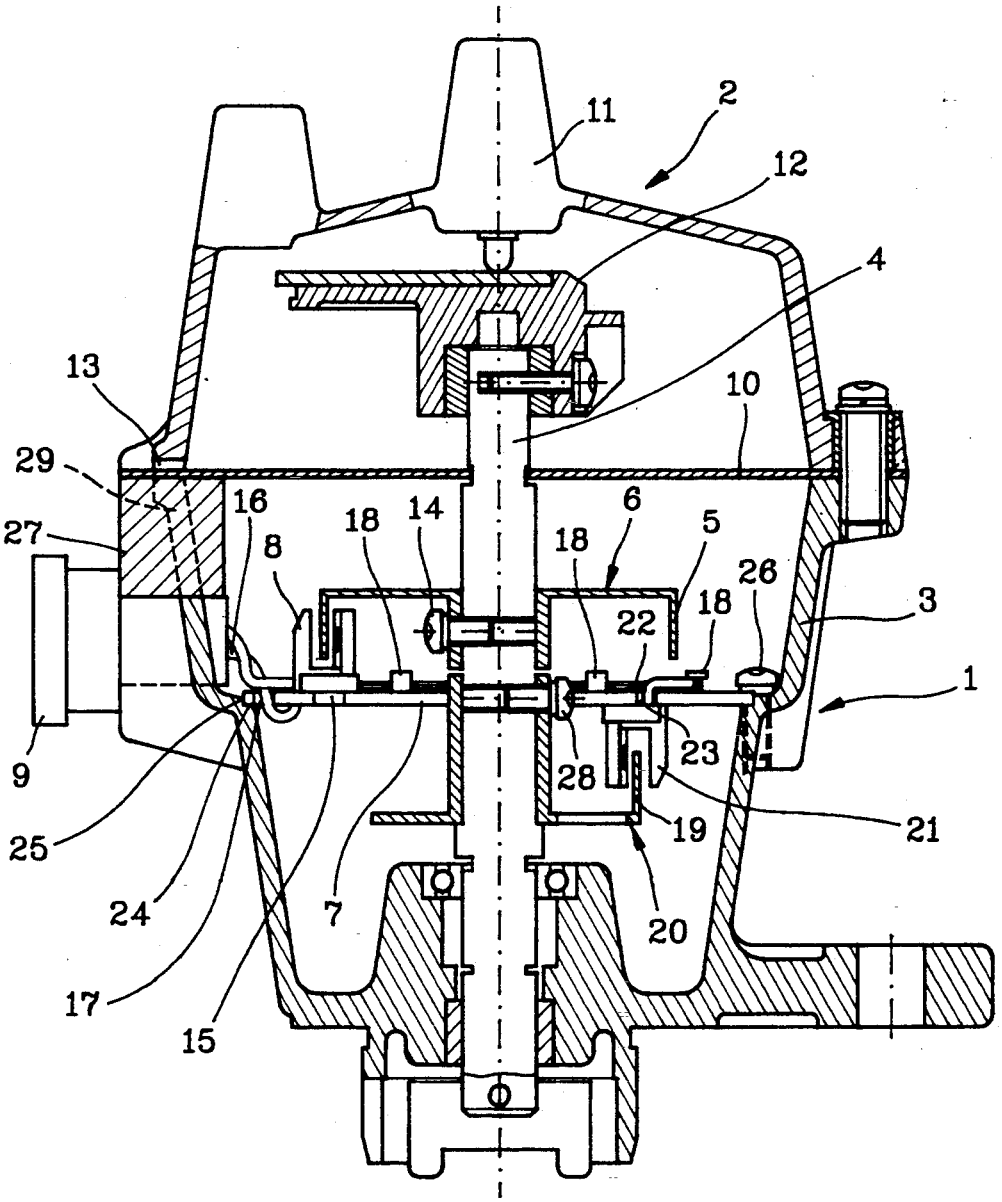
FIG. 1 is a sectional view of an embodiment of a signal generator according to the present invention, being mounted in a distributor.

FIG. 1 is a sectional view of a signal generator 1 mounted in distributor 2 of an engine ignition system; the signal generator 1 comprises a housing 3, a shaft 4 rotatably mounted in the housing 3, at least one vane type rotor 6 with right angle vanes 5 parallel to the shaft 4, which fastened on the shaft 4, a signal element mounting plate 7 fastened to the housing 3, at least one signal element 8, a signal-output socket 9 fastened to the housing 3, and a stray noise isolating plate 10 to cover the housing 3 and to isolate stray noise. One end of the shaft 4 is engaged with the cam shaft or the crank shaft of the engine so as to rotate synchronously with the engine and to drive the vane type rotor 6 to rotate synchronously. When the vane type rotor 6 rotates, it will move across the signal element 8, which is usually a conventional Hall effect sensor. When the magnetic inductive vane type rotor 6 moves across Hall effect sensor, a square wave signal will be generated. Such signal will, through the signal-output socket 9, be transmitted to a micro-computer control unit of an engine management system for controlling the fuel injection and ignition of the engine. The distributor 2 is mounted above the signal generator 1; a distributor cap 11 is mounted over the distributor 2. A distributor rotor 12 is mounted under the distributor cap 11 and on the top end of the shaft 4. The stray noise isolating plate 10 under the distributor rotor 12 is made of a conductive material. The stray-noise isolating plate 10 is used for isolating moisture produced with ozone which is caused by sparks from the distributor rotor 12. Usually, when high voltage passes the distributor contact, a spark will take place, and the spark causes the oxygen in the air to convert into ozone, which is subject to combination with an iron metal to produce an iron-oxide rust. The ozone can also combine with the hydrogen in the air produce moisture, which forms into water drops after a period of time. The water drops speed up the rusting of the surface of an iron. After the stray-noise isolating plate 10 is mounted in place, the ozone in the distributor 2 would drain out of a vent 13 on the distributor cap 11. When the distributor rotor 12 produces sparks, a high voltage stray will be generated to induce the wires of the signal generator 1. If such a high voltage stray noise is not shielded, such induction causes the signal generator 1 to have an abnormal stray noise wave, i.e., to cause the micro-computer control unit of the engine management system to go wrong. In order to provide a correct timing signal to the microcomputer control unit from the signal generator 1, a stray-noise isolating plate 10 made of a metal having good conduction or an electro-plated plastic piece is used to shield the stray noise. The lower end of shaft 4 is engaged with the crank shaft or a cam shaft of the engine so as to have it rotated synchronously with the engine. The first vane type rotor 6 is fastened around the shaft 4 for synchronous rotation. In the embodiment, the first vane type rotor 6 is fastened to the shaft 4 with a screw 14, but the rotor 6 can also be fastened to the shaft 4 by different methods. When the vane type rotor 6 and the shaft 4 rotate synchronously with the engine, the vanes 5 of the vane type rotor 6 will move around a given circumference to move across a signal element 8, which is a conventional Hall effect sensor in the embodiment of this invention. The advantage of such Hall effect sensor is its low cost. The signal element 8 of The Hall effect sensor type is mounted on the signal element mounting plate 7 by means of a rivet, or screw, or other methods through a positioning hole 15 on the mounting plate 7. The signal wires 16 of the signal element 8 pass through a small hole 17, and are connected with a signal-output socket 9. If the signal wires 16 are much longer, they have to be retained in a hook-shaped groove 18 to prevent the signal wires 16 from touching the vane type rotor 6. The second vane type rotor 20 having vanes 19 is also fixedly mounted around the shaft 4, but under the signal element mounting plate 7. The mounting direction of the second vane type rotor 20 is opposite to that of the first vane type rotor 6, and the vanes 5 and 19 as well, but all the vanes face the signal element mounting plate 7. The vanes 19 of the second vane type rotor 20 moves across the second signal element 21 (in this embodiment, conventional Hall effect sensor is used). The second signal element 21 of the Hall effect sensor is fastened under the signal element mounting plate 7 with a rivet or a screw; the signal wires 22 pass through a small hole 23, and are retained in a hook-shaped groove 18 before being connected with the signal-output socket 9. The second signal element 21 generates a second timing signal. The outer edge of the signal element mounting plate 7 has a fastening edge 24, which is fastened to a positioning surface 25 of the housing 3. The positioning surface 25 has a given precision to facilitate the signal element mounting plate 7 being mounted in place with a screw 26. The position of the signal element mounting plate 7 can be adjusted slightly upon the screw 26 being loosened so as to change the relative phase diagram between the timing signal wave and the crank shaft angle. The signal element mounting plate 7, the signal elements 8 and the signal-output socket 9 can be made into an assembly so as to make the signal generator 1 a simple unit. A hole 27 is furnished in the housing 3 above the signal-output socket 9. Through the hole 27, the screws 14 and 28 can be tightened or loosened for the vane type rotors 6 and 20. The signal-output socket 9 can be fastened in place through the hole 27. After the hole 27 is mounted in place, a rubber seal 29 is used to close the hole 27 to prevent debris from entering the signal generator 1, and to hold the signal-output socket 9 in place without becoming loose.

Figure 2:
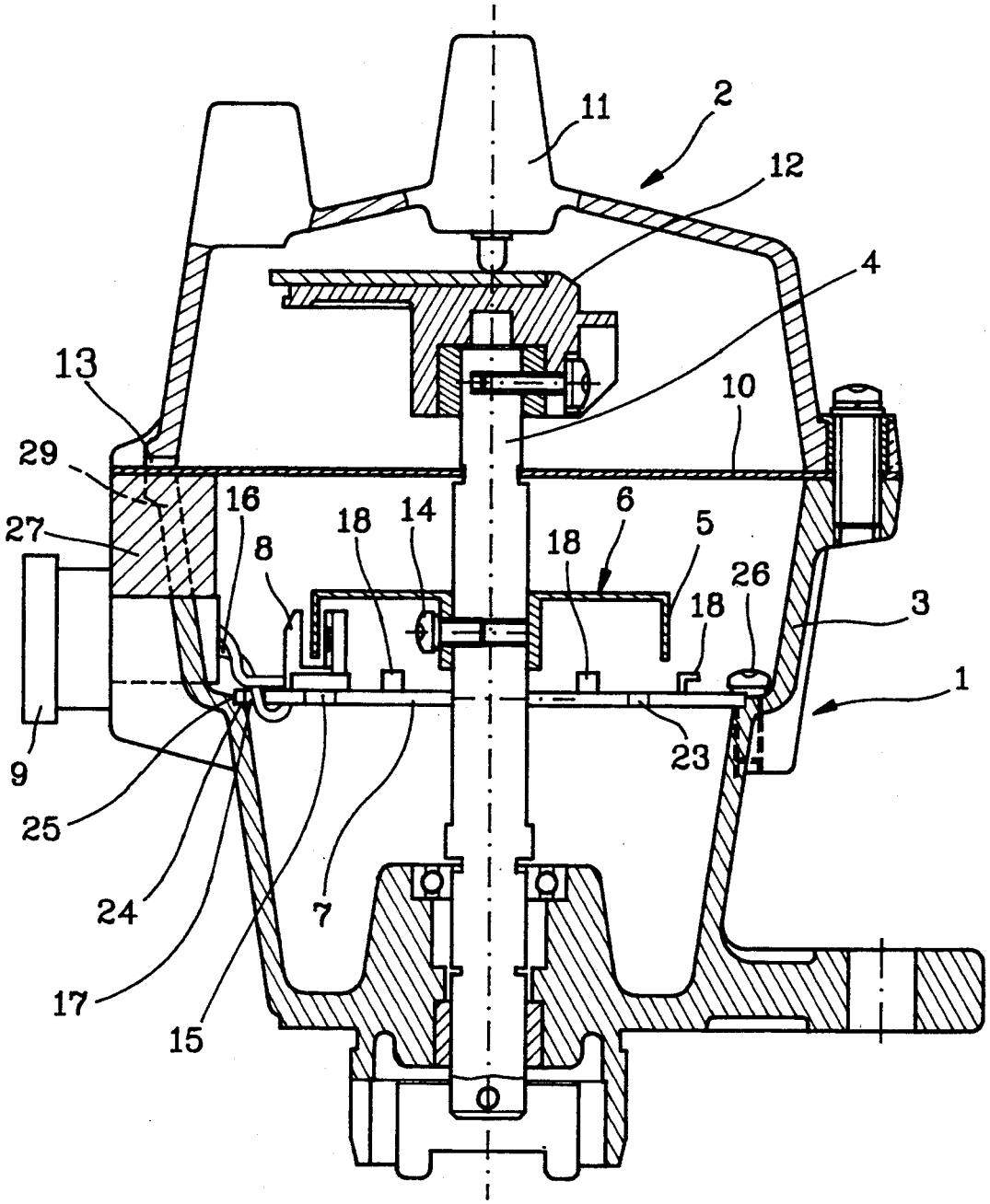
FIG. 2 is a sectional view of embodiment-2 according to the present invention, being mounted in a distributor.
Figure 3:
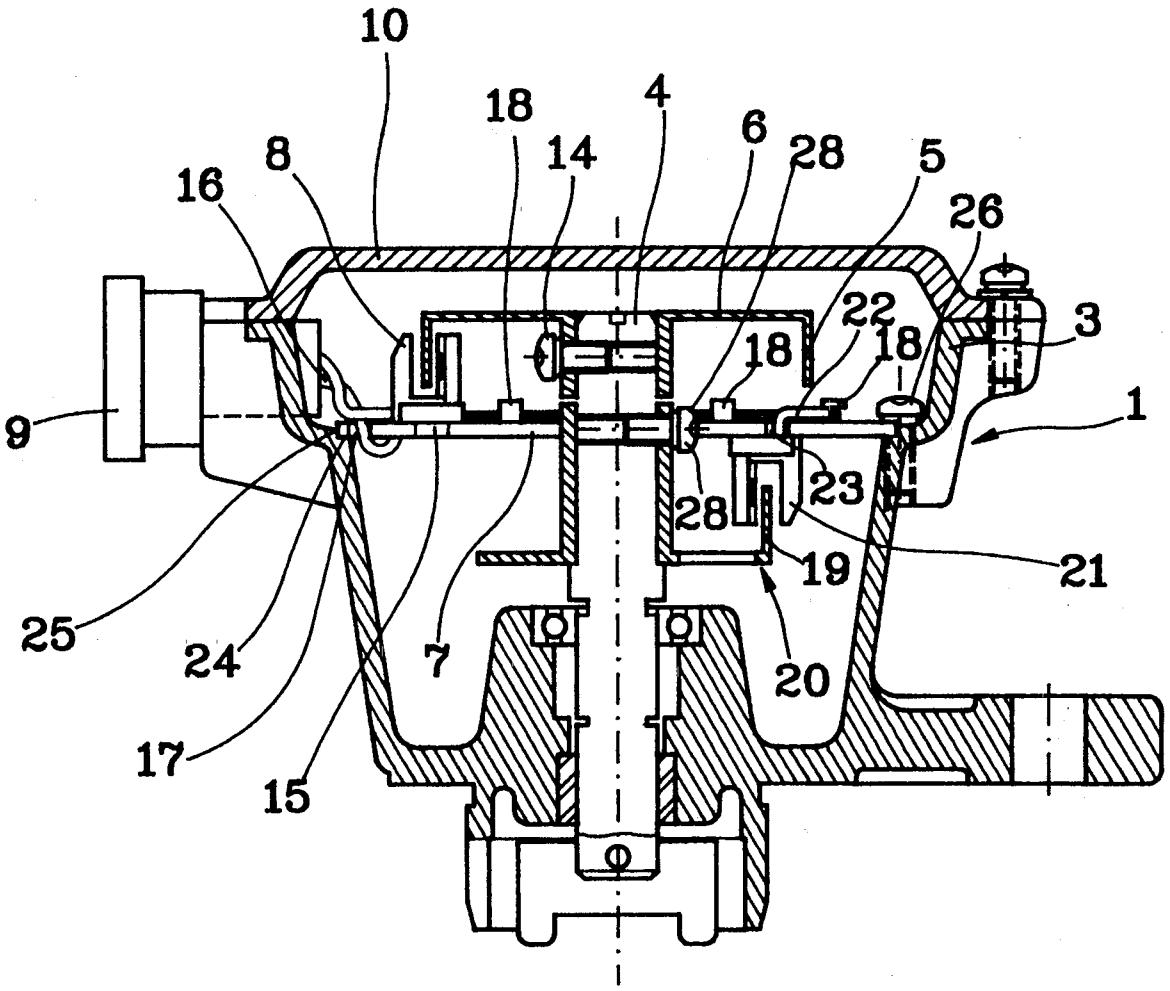
FIG. 3 is a sectional view of an embodiment-3 of a generated signal generator according to the present invention.
Figure 4A:
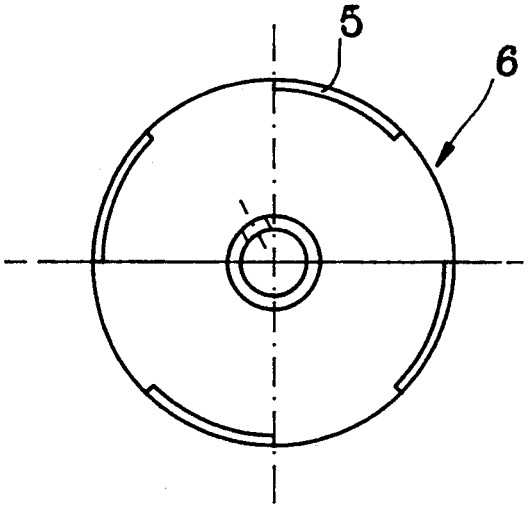
FIG. 4A is a top view of a vane type rotor, being used in a four-cylinder engine.
Figure 4B:
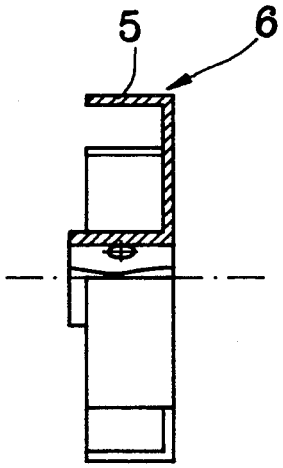
FIG. 4B is a side view of a vane type rotor, being used in a four-cylinder engine.
Figure 4C:
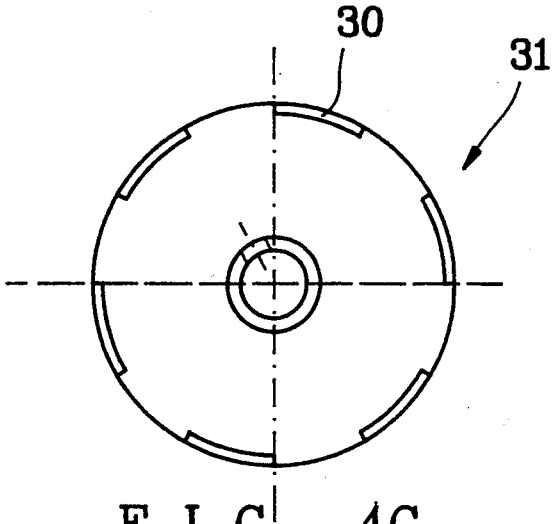
FIG. 4C is a top view of a vane type rotor, being used in a six-cylinder engine.
Figure 4D:
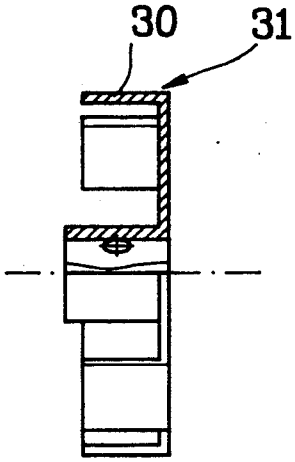
FIG. 4D is a side view of a vane type rotor, being used in a six-cylinder engine.
Figure 4E:
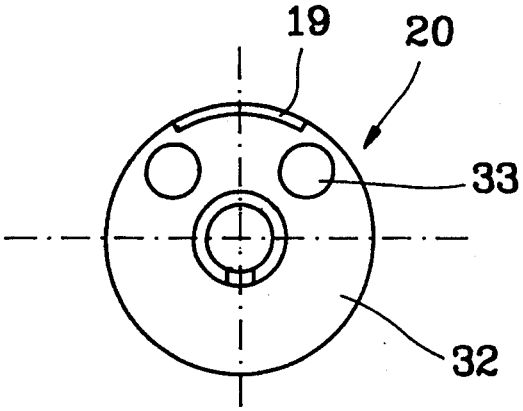
FIG. 4E is a top view of an additional (2nd) vane type rotor at another position on the signal element mounting slate.
Figure 4F:
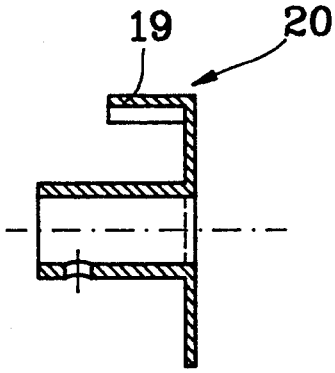
FIG. 4F is a side view of the additional (2nd) vane type rotor as shown in FIG. 4E.
Figure 5:
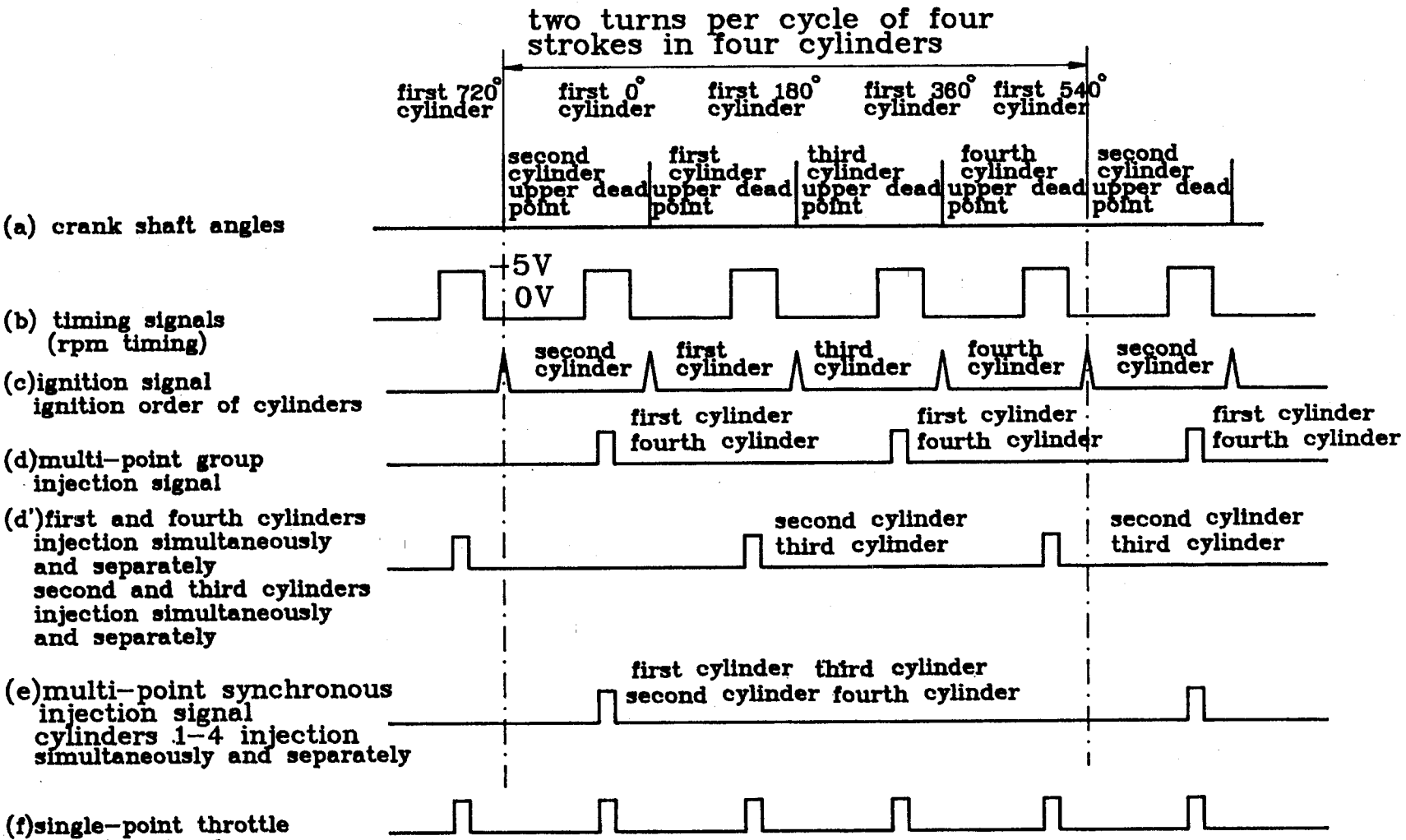

The aforesaid signal generator 1 includes two signal elements 8 and 21 (i.e., the Hall effect sensors), which can generate two timing signals. The wave forms thereof vary with the forms of the vane type rotors 6 and 20. Generally, an advanced engine management system must be furnished with two timing-signal wave forms. One of the timing signals has the same number of wave forms as that of the cylinders. The wave form is used for exactly calculating the angular velocity of the shaft of the engine. As shown in FIGS. 4-1 and 4-2, the vane type rotor 6 is used for a four-cylinder engine. The portion of the vane type rotor 6 across the signal element is the vane 5 in parallel with the center hole of the rotor 6. A four-cylinder engine is mounted with a vane type rotor having four vanes 5. A six-cylinder engine has to be mounted with a vane type rotor 31 having six vanes 30 (as shown in FIGS. 4-3 and 4-4). All the vanes 5 and 30 have to be mounted on one circle, and spaced at a regular angle one another, and the same is true to a eight-cylinder engine or more than eight cylinders. The other timing signal has only one wave form, not being related to the number of cylinders of the engine. This other wave form is used for indicating a reference position of the piston (or pistons). In the event of every cylinder having a fuel injection at different time respectively (i.e., the so-called multi-point sequential injection method), a second timing signal must be used for counting the fuel injection time in the control system; as shown in FIGS. 4-5 and 4-6. The vane type rotor 20 has only one vane 19. Therefore, the vane 19 causes the vane type rotor 20 to have an asymmetrical effect upon rotation, i.e., to generate an asymmetrical vibration. As a result, a portion of the top surface of rotor 20 has to be cut off. These holes 33 maintain a gyration balance. The shape and the operation theory of the single vane 19 are similar to that of the vanes 5 and 30, i.e., to move across the signal element (Hall effect sensor) for generating a signal wave form.

In a simple engine management system, the signal generator 1 requires only one timing signal. In the present invention, only one vane type rotor 6 is furnished (the other single-vane type rotor is omitted), and therefore only one signal element 8 (Hall effect sensor) is required as shown in FIG. 2; then, only one timing signal will be generated. The features and operation theory of the aforesaid signal generator are the same as those of the signal generator 1 which can generate two timing signals, except the vane type rotor 20 with a vane 19 and the signal element 21 being removed, and only the vane type rotor 6 with vanes 5 being left.

Currently, the advanced engine ignition system is no longer mounted with a distributor. Instead, a plurality of ignition coils controlled with a micro-computer are used, i.e., the so-called distributor-less ignition system. In such a case, the signal generator 1 (as shown in FIG. 3) would have no distributor cap 11, no distributor rotor 12 and vent 13 shown in FIGS. 1 and 2. Then, the shaft 4 will be shorter than before. The stray-noise isolating plate 10 has to be made of a conductive material because it is not only being used to shield the stray noise generated by the ignition coils, the spark plugs and the high voltage wires, but it is also used to prevent debris from entering the apparatus. The other parts are the same as those shown in FIG. 1 in terms of features and functions. As a result of the length of the housing 3 being changed, the rubber seal 29 might be omitted. In order to prevent stray noise from interfering with the signal element 8 and the signal wires 16, the housing 3 as shown in FIGS. 1, 2 and 3 has to be made of a conductive material or a conductor-plated material. Then, the stray noise does not affect the inner parts of the signal generator 1. In a high quality-control system, the signal-output socket 9 would also be shielded with electroplating or a metal net, or a conductor.

FIGS. 5 and 6 illustrate the relation among the timing signal, the ignition timing and the fuel-injection timing a four-cylinder and four-stroke engine management system. FIG. 5 illustrates a one timing signal wave for the ignition and fuel injection relation. This type of engine management system is not used to control precision fuel-injection timing. It is only used for a group injection, a simultaneous fuel injection, and a simple-point fuel injection system which require less precision. In FIG. 5, (a) stands for the zero point of the crank shaft angle coordinates, i.e., the top dead center of the first cylinder of a four-cylinder engine; (b) stands for the first timing signal wave, which is used to facilitate the micro-computer to control and count the rotation speed of every section of an engine, and to control the ignition timing, and the fuel-injection timing and duration; (c) stands for the ignition timing positions of every cylinder; (d) and (d') stand for the group injection method of the multi-point-fuel-injection system; (e) stands for another fuel-injection method, which is also a multi-point-fuel-injection system, but is a synchronous injection, i.e., the four cylinders to inject fuel simultaneously; the ignition timing is the same; (f) stands for a single-point fuel injection system, which indicates the fuel-injection timing and duration of the throttle injection, and the ignition timing is the same as that of (c) mentioned above. FIG. 6 illustrates the relation between the ignition timing and fuel injection by means of two timing signal waves, in which (a) stands for the crank shaft angle coordinates; (b) stands for the second timing signal wave to indicate the first piston position as a reference point; (c) stands for the first timing signal wave to provide a rotation speed counting data so as to enable the micro-computer to control the nozzles of all the cylinders respectively, and to provide a precise sequential injection in a multi-point-fuel-injection system as shown in (e); (d) stands for an ignition timing, which is the same as that of the three fuel injection method as shown in FIG. 5.

The present invention not only can be mounted on and coupled with the cam shaft of an engine, but also can be coupled with the crank shaft, or a mechanism that can be in synchronous with an engine. The signal element according to the present invention not only can be used as a Hall effect sensor, but also can be used to generate an induced electric signal (such as voltage, current, resistance, inductance, capacitance and electromagnet force). Moreover, the number of signal elements in the present invention is at least one, or two, or more than two, and the same is true for the number of the vane type rotors. The signal element mounting plate has at least one layer but is also can more than one layer.

I claim:

1. A signal generator for an internal combustion engine comprising:

a housing;

a shaft, at least one asymmetrical vane type rotor coupled to said shaft, one signal element mounting plate, at least one signal element, and a stray noise isolating plate provided in said housing, said shaft penetrating through said signal element mounting plate and said stray noise isolating plate;

wherein said shaft is coupled with the engine to drive said asymmetrical vane type rotor to rotate synchronously with the engine and move pass said signal element so as to generate a square wave signal for controlling a fuel injection and ignition of the engine;

said signal element mounting plate having top and bottom surfaces and being mounted on said housing via an outer edge of said mounting plate, which is used as a fulcrum and to cause said signal element mounting plate to be fastened in place in such a manner so as to allow a large space to be provided by said top and bottom surfaces for mounting a large number of said signal elements thereon;

said stray noise isolating plate being mounted over said vane type rotor and said signal elements to form a closed space of said housing and to shield high voltage stray noises and prevent ozone produced by sparks from entering said housing.

2. The signal generator for an internal combustion engine according to claim 1 wherein said top and said bottom surfaces of said signal mounting plate are both fastened with a plurality of said signal elements.

3. The signal generator for an internal combustion engine according to claim 1 wherein said stray noise isolating plate is made of a conductive material.

4. The signal generator for an internal combustion engine according to claim 1 wherein said asymmetrical vane type having a top surface furnished with a plurality of holes for maintaining said rotor in a balanced rotation.

5. The signal generator for an internal combustion engine according to claim 1 which contains at least one said asymmetrical vane type rotor fastened above and under said signal element mounting plate so as to generate at least two signals when said asymmetrical vane type rotors moving pass said signal elements mounted on said signal element mounting plate.

6. The signal generator for an internal combustion engine according to claim 1 wherein either of said top or bottom surfaces is provided with a hook-shaped groove for fastening a signal wire connecting said plurality of signal elements.

7. The signal generator for an internal combustion engine according to claim 6 wherein said signal elements, said signal wire and said signal mounting plate are assembled as an integral piece before being placed inside said housing.

* * * * *